US007721927B2

(12) United States Patent
Osuga

(10) Patent No.: US 7,721,927 B2
(45) Date of Patent: May 25, 2010

(54) POWER DRIVE NAILING MACHINE

(75) Inventor: Satoshi Osuga, Tokyo (JP)

(73) Assignee: Max Co., Ltd., Tokyo (JP)

( * ) Notice: Subject to any disclaimer, the term of this patent is extended or adjusted under 35 U.S.C. 154(b) by 257 days.

(21) Appl. No.: 11/664,809

(22) PCT Filed: Sep. 21, 2005

(86) PCT No.: PCT/JP2005/017360

§ 371 (c)(1),
(2), (4) Date: Apr. 6, 2007

(87) PCT Pub. No.: WO2006/040911

PCT Pub. Date: Apr. 20, 2006

(65) Prior Publication Data

US 2009/0001119 A1 Jan. 1, 2009

(30) Foreign Application Priority Data

Oct. 8, 2004 (JP) ..... 2004-296270

(51) Int. Cl.
*B25C 7/02* (2006.01)

(52) U.S. Cl. ..... 227/8; 227/9; 227/10; 227/130; 123/46 SC

(58) Field of Classification Search ..... 227/9, 227/10, 130, 142, 8; 123/46 S
See application file for complete search history.

(56) References Cited

U.S. PATENT DOCUMENTS 5,219,110 A * 6/1993 Mukoyama ..... 227/8
5,385,286 A 1/1995 Johnson, Jr.
5,687,899 A * 11/1997 Dohi et al. ..... 227/10
5,715,982 A * 2/1998 Adachi ..... 227/8
5,839,638 A * 11/1998 Ronn ..... 227/8
6,024,267 A 2/2000 Chen
6,145,724 A 11/2000 Shkolnikov et al.
6,170,729 B1 1/2001 Lin
6,427,896 B1 8/2002 Ho et al.
6,581,815 B1 6/2003 Ho et al.
6,763,992 B2 * 7/2004 Hirai ..... 227/142
6,851,595 B1 * 2/2005 Lee ..... 227/142
7,040,521 B2 * 5/2006 Kolodziej et al. ..... 227/10
7,097,083 B2 * 8/2006 Kolodziej et al. ..... 227/8
7,318,546 B2 * 1/2008 Segura et al. ..... 227/142
2003/0080172 A1 * 5/2003 Hirai ..... 227/142
2004/0238593 A1 * 12/2004 Tachihara et al. ..... 227/142

(Continued)

FOREIGN PATENT DOCUMENTS

CN 1274633 A 11/2000

(Continued)

*Primary Examiner*—Rinaldi I. Rada
*Assistant Examiner*—Nathaniel Chukwurah
(74) *Attorney, Agent, or Firm*—Drinker Biddle & Reath LLP

(57) ABSTRACT

A nailing machine includes a contact rod substantially in a straight shape and an operating dial. The contact rod is slidably and rotatably supported by a nose portion. The operating dial is slidably penetrated to be inserted by the contact rod, rotatably provided integrally with the contact rod and provided rotatably and by being restricted from being moved in an up and down direction with respect to the nose portion. A length of projecting the contact member in a direction of a front end of the nose portion is adjusted by rotating the contact rod by way of the operating dial.

10 Claims, 8 Drawing Sheets

U.S. PATENT DOCUMENTS

2008/0023516 A1* 1/2008 Chang ..... 227/8

FOREIGN PATENT DOCUMENTS

EP 1 236 544 A2 9/2002
JP 60-117072 8/1985
JP 4-122581 4/1992
JP 5-26275 4/1993
JP 5-86474 11/1993
JP 3527571 2/2004

* cited by examiner

POWER DRIVE NAILING MACHINE

TECHNICAL FIELD

The present invention relates to a power drive nailing machine for impulsively driving a piston contained at inside of a cylinder by a pressure of compressed air or a combustion gas or the like and striking a fastener of a nail, a pin or the like supplied to inside of an injection port to a struck member of wood, concrete or a steel plate or the like by a driver coupled to the piston.

BACKGROUND ART

There are a compressed air drive nailing machine for driving a piston at inside of a cylinder by introducing compressed air to inside of the cylinder containing the piston and striking a nail to a struck member of wood or the like by a driver coupled to the piston, and a combustion gas drive nailing machine formed with a combustion chamber at inside of a housing for generating a combustion gas at high pressure at inside of the combustion chamber by injecting a combustible gas to inside of the hermetically closed combustion chamber and combusting the combustible gas, impulsively driving the piston at inside of the cylinder by operating the combustion gas to the piston slidably contained at inside of the cylinder and striking a nail to a steel plate, concrete, wood or the like by a driver coupled to the piston.

In such power drive nailing machines, a lower side of the housing containing the cylinder is coupled with a nose portion formed with the injection port for striking and guiding a nail to a work member. The driver coupled to a lower face of the piston contained at inside of the cylinder is contained at inside of the injection port to be guided thereby. A rear side of the nose portion is continuously provided with a magazine containing a number of nails. The nail supplied from the magazine to inside of the injection port of the nose portion is struck from the injection port to the struck member arranged at a front end of the nose by the driver.

The power drive nailing machine for driving the piston by the compressed air or the combustion gas as described above is provided with a contact member slidably supported along an outer peripheral face of the nose portion. Ordinarily, the contact member is arranged to project in a direction of a front end of the injection port. An upper end of a contact arm connected to the contact member is connected to be engaged with an activation control apparatus for activating the power drive nailing machine. When the power drive nailing machine is positioned to a nail striking position by bringing the nose portion of the power drive nailing machine into contact with the struck member, by engaging the contact member with the struck member to operate to slide along the nose portion, the activation control apparatus is operated by way of the contact arm, and the power drive nailing machine is set to a startable state.

JP-B2-3527571 discloses a power drive nailing machine formed with a strike depth adjusting apparatus for arbitrarily adjusting a depth of striking a nail at inside of an injection port to a struck member by a driver connected to a piston impulsively driven by compressed air or a combustion gas. According to the power drive nailing machine, a length of projecting a contact member can variably be adjusted such that a front end face of the contact member in being slid to move up to an upper dead center along a nose portion is made to constitute an arbitrary projected length from a front end face of the injection port of the nose portion. Therefore, a front end of the injection port: of the nose portion can be made to be spaced apart from a struck face of a struck member by an arbitrary interval. The strike depth adjusting apparatus is constituted by a plate-like portion extended from the contact member to an upper side, and a lower end portion of a contact arm an upper end of which is connected to be engaged with an activation control apparatus and formed in a plate-like shape. By bringing recessed and projected faces of numbers of streaks formed at respective faces of two sheets of plate-like members opposed to each other in mesh with each other at arbitrary positions, the two plate-like members are fixed by a screw or the like.

According to the strike depth adjusting apparatus in which the recessed and projected faces formed at the respective faces of the plate-like members opposed to each other are brought in mesh with each other and fixed by a screw or the like, when a user adjusts a strike depth, the screw fastening the plate-like members is relaxed by using a tool of a wrench or the like. After shifting the respective recessed and projected faces of two sheets of the plate-like members to be brought in mesh with each other again, the user fastens the screw by using the tool again. Therefore, there is a case in which an adjusting operation cannot be carried out in an operation above an unstable foothold. Further, in order to connect the contact member and the contact arm by the screw or the like, a portion of connecting these is arranged at a side face of the nose portion. Therefore, the contact arm is arranged to be bent relative to a direction of operating the contact member and a direction of operating the activation control apparatus. As a result, when the contact member is operated to slide along the nose portion, there is a case in which the contact arm is deformed and the operation of sliding the contact member cannot firmly be transmitted to the activation control apparatus, the power drive nailing machine cannot be activated or operated erroneously.

DISCLOSURE OF THE INVENTION

One or more embodiments of the invention provide a nailing machine including a strike depth adjusting apparatus capable of easily operating to adjust a length of projecting a contact member from a front end of a nose portion without needing a tool, further, capable of preventing an erroneous operation brought about by deforming a contact arm by transmitting movement of the contact member along the nose portion directly to an activation control apparatus.

According to one or more embodiments of the invention, a nailing machine is provided with a nose portion forming an injection port for sliding to guide a driver for striking a nail, a contact member arranged to be projected in a direction of a front end of the injection port of the nose portion, an activation control apparatus for activating the power drive nailing machine, by operating to slide the contact member along the injection port, a guide hole provided at a side face portion of the nose portion and formed to be substantially in parallel with the injection port, a contact rod substantially in a straight shape inserted into the guide hole and slidably and rotatably supported by the guide hole, connected to the activation control apparatus on a side of an upper end portion thereof and screwed to be connected to the contact member on a side of a lower end portion thereof, and an operating dial provided rotatably integrally with the contact rod by being slidably penetrated to be inserted into the contact rod and being rotatable and restricted from being moved in an up and down direction with respect to the nose portion. A length of projecting the contact member in a direction of a front end of the nose portion of the contact member is variably adjusted by rotating the contact rod by way of the operating dial.

Further, according to one or more embodiments of the invention, a nailing machine is provided with a strike mechanism constituted by a cylinder provided at inside of the housing, and a piston driven at inside of the cylinder by a combustion gas generated at inside of a combustion chamber formed on a side of an upper portion of the cylinder. The activation control apparatus is provided by constituting a variable valve for opening and closing an interval between the combustion chamber and the atmosphere. The contact rod is connected to a side of the variable valve by penetrating a flange portion formed at an upper end of the nose portion on a side of the upper end portion. The combustion chamber is shut off from the atmosphere to be hermetically closed by operating the movable valve by way of the contact rod by bringing the contact member into contact with the struck member to be operated to slide.

Further, according to one or more embodiments of the invention, the operating dial is formed by a material having a small thermal conductivity of a synthetic resin or the like.

According to one or more embodiments of the invention, a nailing machine comprises a nose portion, an injection port formed at the nose portion, a contact member arranged to be projected in a direction of a front end of the injection port and sliding along the nose portion, a guide hole provided at a side portion of the nose portion, a contact rod which is slidably and rotatably inserted into the guide hole and a lower end portion of which is screwed to be connected to the contact member, and an operating dial penetrated to be inserted slidably by the contact rod, made to be rotatable integrally with the contact rod, and restricted from being moved rotatably in an up and down direction by the nose portion.

Further, according to one or more embodiments of the invention, when the operating dial is rotated, the contact rod is rotated and a length of projecting the contact member in a direction of a front end of the nose portion is adjusted.

Further, according to one or more embodiments of the invention, the nailing machine further includes an activation control apparatus for activating the nailing machine. An upper end portion of the contact rod is connected to the activation control apparatus. The nailing machine is activated by operating to slide the contact member.

Further, according to one or more embodiments of the invention, the nailing machine further comprises a housing, a cylinder provided at inside of the housing, a combustion chamber formed on a side of an upper portion of the cylinder, and a piston driven at inside of the cylinder by a combustion gas generated at inside of the combustion chamber. The activating control apparatus includes a movable valve for opening and closing an interval between the combustion chamber and the atmosphere. The contact rod is connected to a side of the movable valve by penetrating a flange portion formed at an upper end of the nose portion on a side of the upper end portion. The combustion chamber is shutoff from the atmosphere to be hermetically closed by operating the movable valve by way of the contact rod by bringing the contact member into contact with the struck member to be operated to slide.

Further, according to one or more embodiments of the invention, the contact rod includes a male screw at the lower end portion, the contact member includes a female screw, and the male screw and the female screw are screwed to be connected.

Further, according to one more embodiments of the invention, the contact rod includes a female screw at the lower end portion, the contact member includes a male screw, and the female screw and the male screw are screwed to be connected.

Further, according to one or more embodiments of the invention, the contact rod includes a hexagonal section portion, the operating dial includes a hexagonal hole, and the hexagonal section portion is inserted into the hexagonal hole slidably in an axial direction of the contact rod, and the contact rod and the operating dial are integrally rotated.

Further, according to one or more embodiments of the invention, the nailing machine further comprises a flange portion provided at the nose portion, and a guide member provided on a lower side of the flange portion. The operating dial is arranged by being interposed by the flange portion and the guide portion and is restricted from being moved in an up and down direction.

Further, according to one or more embodiments of the invention, the operating dial is formed by a synthetic resin.

Further, according to one or more embodiments of the invention, the contact rod is constituted substantially by a straight shape.

According to one or more embodiments of the invention, there is formed the guide hole provided at the side face portion of the nose portion to be substantially in parallel with injection port, the contact rod substantially in a straight shape is supported by the guide hole slidably and rotatably by being inserted into the guide hole, the side of the upper end portion of the contact rod is connected to the activation control apparatus and the side of the lower end portion thereof is screwed to be connected to the contact member. Therefore, when the power drive nailing machine is started, sliding movement of the contact member operated by the struck member is linearly transmitted to the contact rod, and the contact rod is operated to slide in parallel with the injection port of the nose portion to operate the activation control apparatus. As a result, the power drive nailing machine can firmly be activated. Further, according to such a contact rod, a part thereof can be fabricated without hardly working an outer shape or the like by using, for example, a material on sale having a hexagonal section and therefore, a significant reduction in cost can be achieved.

Further, there is provided the operating dial rotatably provided integrally with the contact rod by being penetrated to be inserted slidably by the contact rod and restricted from being moved in the up and down direction rotatably by the nose portion, and the length of projecting the contact member in a direction of the front end of the nose portion is variably adjusted by rotating the contact rod by way of the operating dial. Therefore, when the operating dial is operated to rotate in order to adjust the strike depth, the operating dial can be operated to rotate always at a constant portion without moving the operating dial in the axial direction and therefore, the strike depth can easily be operated to adjust.

Further, the nailing machine is a combustion gas drive nailing machine including a strike mechanism constituted by a cylinder provided at inside of a housing, and a piston driven at inside of the cylinder by a combustion gas generated at inside of a combustion chamber formed on a side of an upper portion of the cylinder. The activation control apparatus is provided as a movable valve for opening and closing an interval between the combustion chamber and the atmosphere, the contact rod is connected to a side of the movable valve by penetrating a flange portion formed at an upper end of the nose portion on a side of the upper end portion, and the combustion chamber is shut off from the atmosphere to be hermetically closed by operating the movable valve by way of the contact rod by bringing the contact member into contact with the struck member to be operated to slide. Therefore, when the combustion gas drive nailing machine is started, sliding movement of the contact member operated by the struck member is linearly transmitted to the contact rod. Further, the movable valve for hermetically closing the combustion chamber by the contact rod is operated and therefore, the combustion gas drive nailing machine can firmly be started and a danger by an erroneous operation can be prevented.

Further, the operating dial is formed by a material having a small thermal conductivity of a synthetic resin or the like. Therefore, even when a temperature of a metal made part of the nose portion, the contact rod or the like is elevated by the combustion gas at high temperatures generated at inside of the combustion chamber, a temperature of the operating dial formed by a synthetic resin or the like having a small thermal conductivity is not elevated and an operation of adjusting the strike depth can safely be carried out.

Other aspects and advantages of the invention will be apparent from the following description and the appended claims.

BRIEF DESCRIPTION OF THE DRAWINGS

FIG. 7(*b*) shows a state of positioning the nose portion to a struck member and operating the contact member by the struck member in the strike depth adjusting apparatus in which the depth of striking the nail is adjusted to be the deepest.

FIG. 8(*b*) shows a state of positioning the nose portion to the struck member and operating the contact member by the struck member in the strike depth adjusting apparatus in which the depth of striking the nail is adjusted to be the shallowest.

DESCRIPTION OF REFERENCE NUMERALS AND SIGNS

Figure 1:
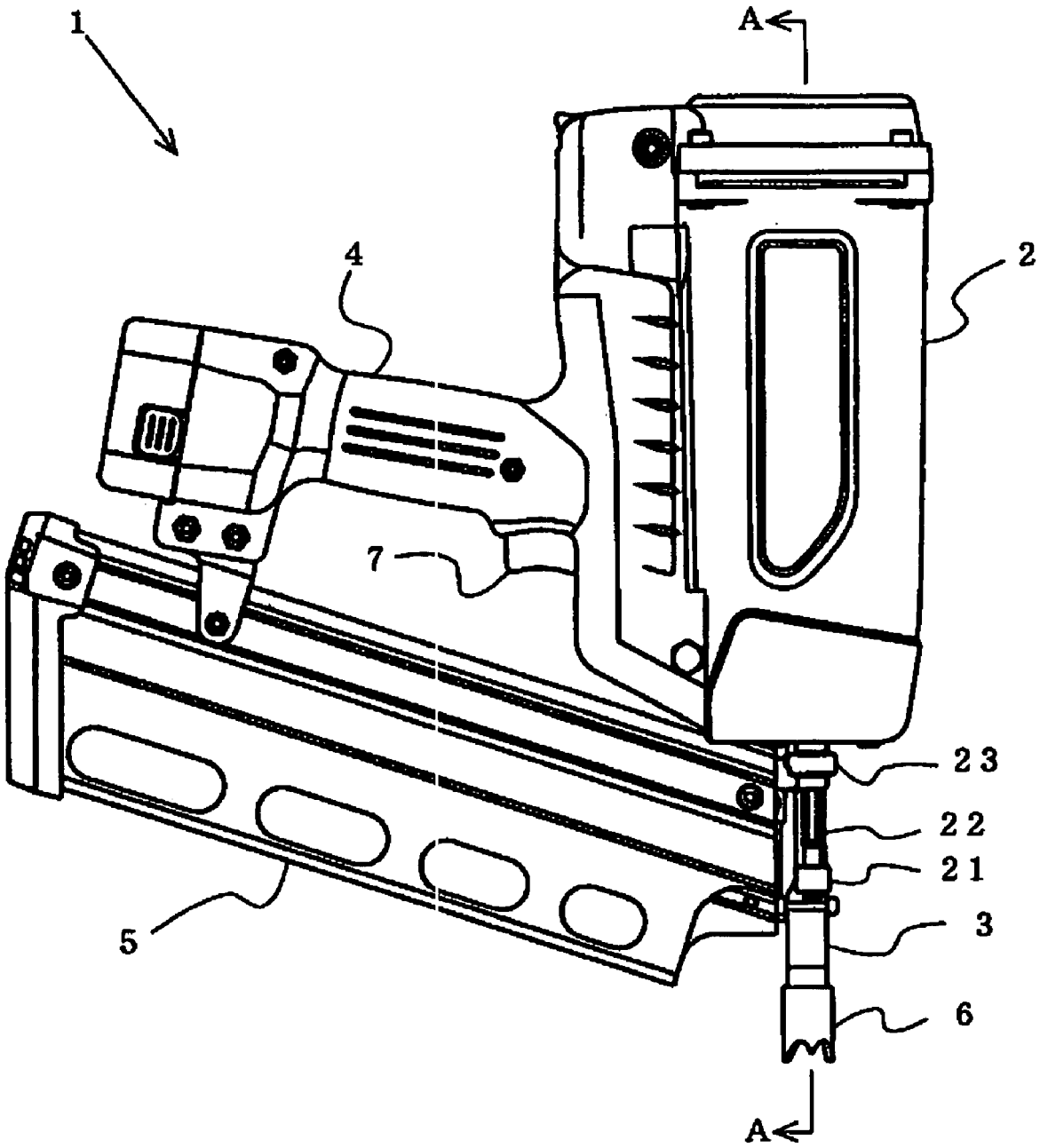
FIG. 1 is a side view of a combustion gas drive nailing machine according to an embodiment of the invention.

1 . . . combustion gas drive nailing machine
3 . . . nose portion
6 . . . contact member
18 . . . female screw portion
19 . . . guide member
20 . . . guide hole
21 . . . male screw portion
22 . . . contact rod
23 . . . operating dial
24 . . . hexagonal hole
25 . . . hexagonal section portion

BEST MODE FOR CARRYING OUT THE INVENTION

An embodiment of the invention will be explained in reference to the drawings as follows.

Embodiment 1

FIG. 1 shows the combustion gas drive nailing machine 1 as an example of a power drive nailing machine. The combustion gas drive nailing machine 1 is constituted by a housing 2 containing a drive mechanism, the nose portion 3 formed with an injection port for guiding a nail to a struck member and attached to a lower end portion of the housing 2, and a magazine 5 supported between a grip portion 4 formed integrally with a rear side of the housing 2 and the rear side of the nose portion 3 and containing a number of nails. Further, the combustion gas drive nailing machine 1 includes the contact member 6 arranged to project in a direction of a front end of the nose portion 3. The combustion gas drive nailing machine 1 is activated by bringing the contact member 6 into contact with a struck member to be operated to slide along the nose portion 3 and operating a trigger formed at a base portion of the grip portion 4 by the hand grabbing the grip portion 4.

Figure 2:
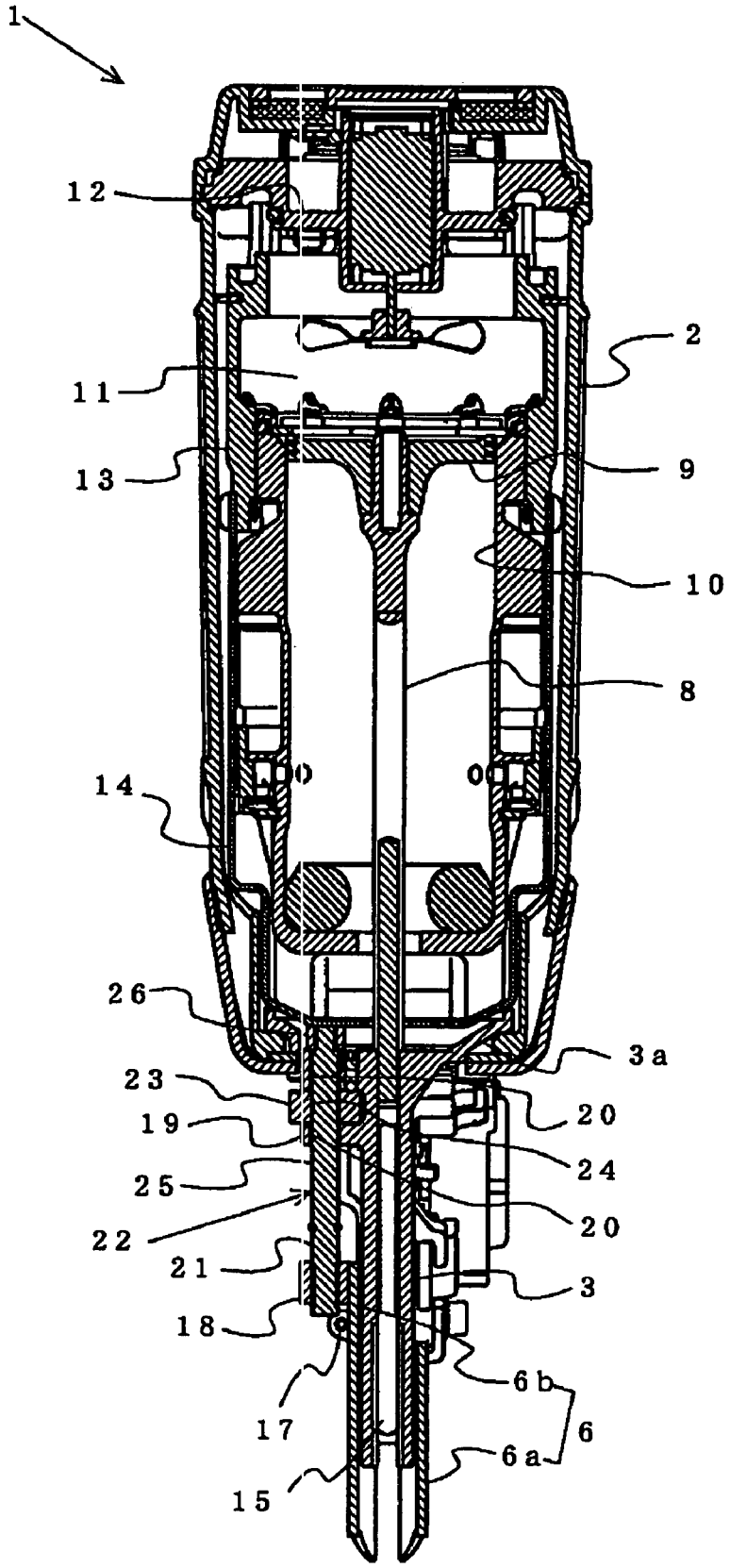
FIG. 2 is a sectional view taken along a line A-A of FIG. 1.

As shown by FIG. 2, inside of the housing 2 of the combustion gas drive nailing machine 1 is contained with a cylinder 10 slidably containing a piston 9 connected with a driver 8 for striking a nail on a side of a lower face thereof. An upper end of the cylinder 10 is formed with a combustion chamber 11 for combusting a combustible gas. An upper face of the piston 9 contained at inside of the cylinder is made to face the combustion chamber 11. The piston 9 is driven at inside of the cylinder 10 by a pressure of a combustion gas generated by combusting the combustible gas at inside of the combustion chamber 11. The combustible gas is charged in a vessel of, for example, a gas cylinder or the like, and the vessel is mounted to inside of the housing 2. By operating the contact member 6, the combustion chamber 11 is hermetically closed and the combustible gas is supplied to inside of the hermetically closed combustion chamber 11. A mixed gas is generated by mixing the combustible gas with air at inside of the combustion chamber 11. By operating the trigger 10, the mixed gas is ignited and is combusted explosively.

Figure 3:
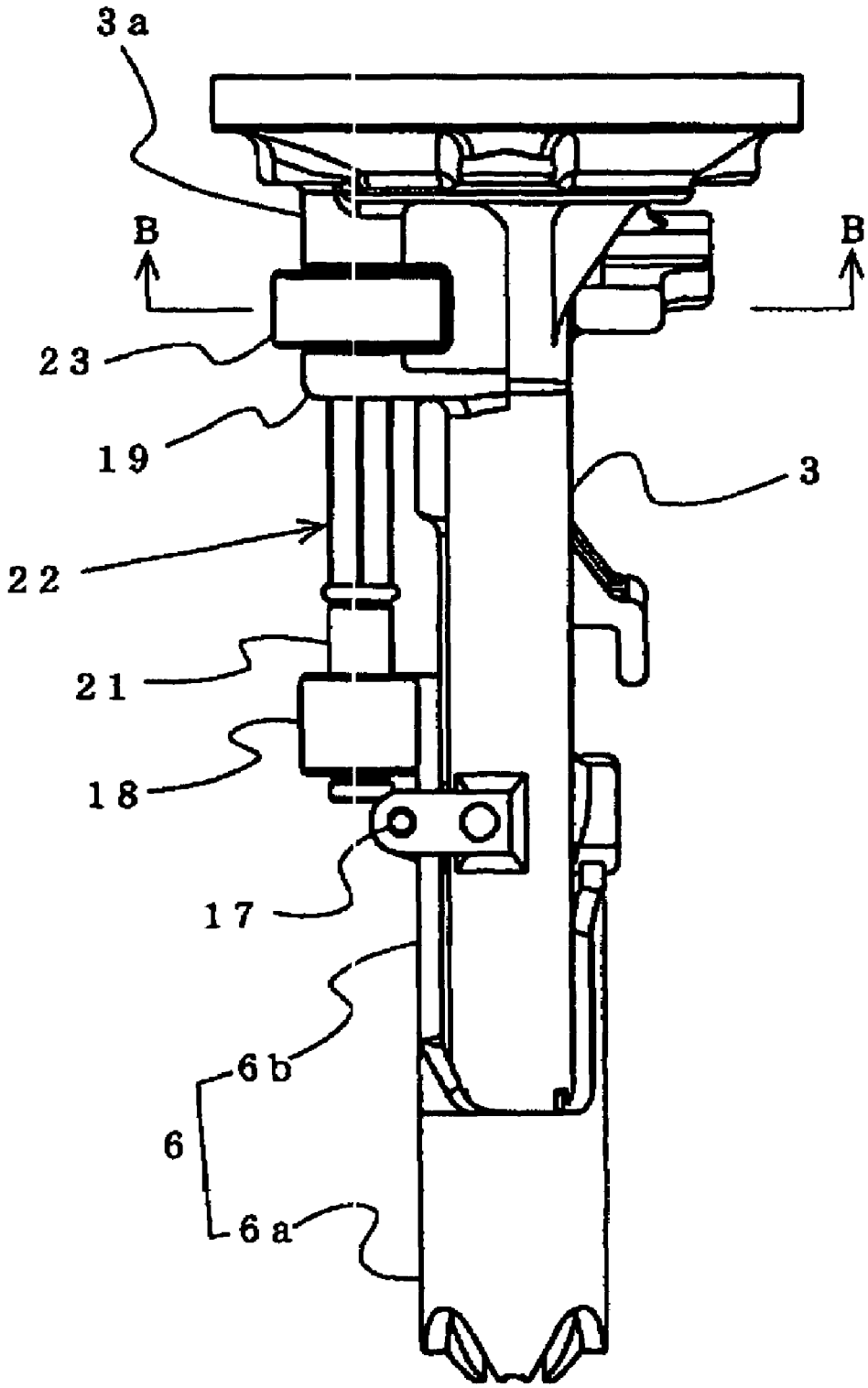
FIG. 3 is a front view enlarging a nose portion of the combustion gas drive nailing machine of FIG. 1.

The combustion chamber 11 is partitioned by an upper end portion of the cylinder 10 and a partition wall 12 formed at an upper end of the housing 2 and a movable valve 13 formed in a ring-like shape between the upper end of the cylinder 10 and the partition wall 12. In order to exhaust the combustion gas at inside of the combustion chamber 11 and the cylinder 10 after driving the combustion gas drive nailing machine 1 to the atmosphere, the movable valve 13 forming an outer peripheral wall of the combustion chamber 11 is formed slidably in an up and down direction. At nonoperational time in which the combustion gas drive nailing machine 1 is not driven, the movable valve 13 is arranged in the lower direction to communicate the combustion chamber 11 with the atmosphere. A lower end of the movable valve 13 is connected to a link member 14 arranged at a space formed between an inner peripheral face of the housing 2 and an outer peripheral face of the cylinder 10. As shown by FIG. 3, the movable valve 13 is operated to an upper side by operating the link member 14 to the upper side, and the combustion chamber 11 is shut off from the atmosphere to be hermetically closed. A lower end portion of the link member 14 is extended to a lower end portion of inside of the housing 2 and is arranged on an upper side of the nose portion 3.

As shown by FIG. 2 and FIG. 3, the nose portion 3 attached to a lower portion of the housing 2 is formed with an injection port 15 for striking and guiding a nail to a struck member. The driver 8 coupled to the piston 9 is contained at inside of the injection port 15 to be slidably guided thereby. Further, the injection port 15 is communicated with the magazine 5 connected to the nose portion 3 by way of an opening formed to direct to a rear side of the nose portion 3. Nails charged to inside of the magazine 5 are successively supplied to inside of the injection port 15 by way of the opening. Further, by driving the piston 9 by the combustion gas at inside of the cylinder 10, the driver 8 is driven at inside of the injection port 15, and the nail supplied to inside of the injection port 15 is struck from inside of the injection port 15 to a struck member arranged at a front end of the nose portion 3.

A front end portion of the nose portion 3 formed in a cylindrical shape is provided with the contact member 6 slidable along the injection port 15 of the nose portion 3. A front end portion 6*a* of the contact member 6 is formed substantially in a ring-like shape by bending a metal plate. The front end portion 6*a* in the ring-like shape is mounted to an outer periphery of the front end portion of the nose portion 3. An upper end portion 6*b* in a plate-like shape extended from the contact member 6 integrally to the upper side is loosely fitted between a guide pin 17 both ends of which are supported by the nose portion 3 and the nose portion 3. Thereby, the contact member 6 is slidably supported along the injection port 15 of the nose portion 3. An end portion of the upper end portion 6*b* of the contact member 6 extended to the upper side is formed with the female screw portion 18 fixedly attached with a nut by welding or the like.

Further, an upper end of the nose portion 3 is formed with a flange portion 3*a* for attaching the nose portion 3 to the lower end of the housing 2. A side of a lower face of the flange portion 3*a* is formed with the guide member 19 to be spaced apart from the lower face of the flange portion 3*a* by a predetermined interval therebetween. The guide hole 20 extended in parallel with an axis line of the injection port 15 from inside of the housing 2 along a side face of the nose portion 3 is formed to penetrate the flange portion 3*a* and the guide member 19. The contact rod 22 formed with the male screw portion 21 screwed to the female screw portion 18 of the contact member 6 at a lower end side thereof is held at inside of the guide hole 20 in a slidable and rotatable state along the injection port 15 of the nose portion 3.

Figure 4:
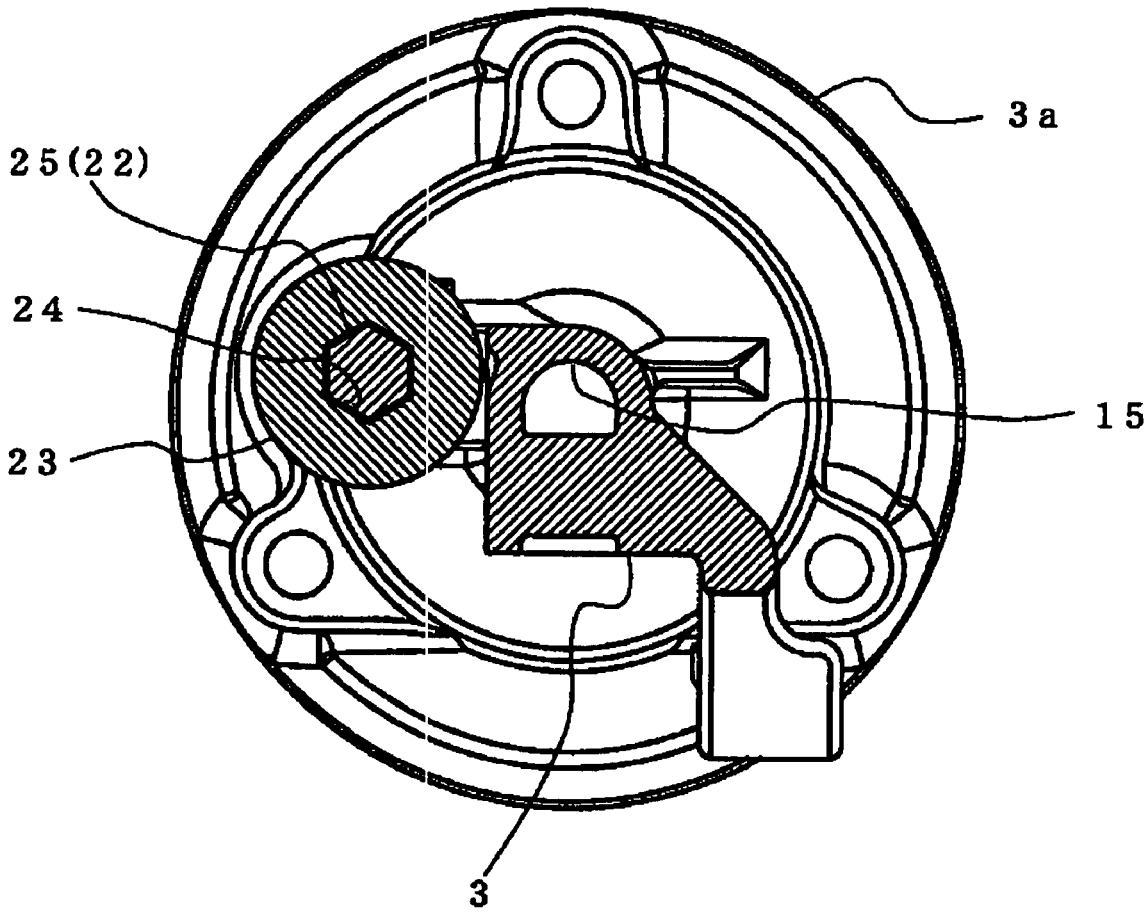
FIG. 4 is a sectional view taken along a line B-B of FIG. 3.

An operating dial 23 in a ring-like shape for operating to rotate the contact rod 22 is arranged between the flange portion 3*a* formed with the guide hole 20 and the guide member 19 formed to be remote from a lower side of the flange portion 3*a* by a predetermined interval rotatably and to be restricted from moving in an up and down direction relative to the nose portion 3. The hexagonal hole 24 formed at a center of the operating dial 23 and the guide hole 20 formed at the flange portion 3*a* and the guide member 19 are arranged to match with each other. As shown by FIG. 4, a sectional shape of a portion of the contact rod 22 penetrating the guide hole 20 formed at the flange portion 3*a* and the guide member 19 is formed in a hexagonal shape. The hexagonal section portion 25 is loosely fitted to inside of the hexagonal hole 24 formed at the operating dial 23. Thereby, the contact rod 22 is held at inside of the guide hole 20 formed at the flange portion 3*a* and the guide member 19 and inside of the hexagonal shape hole 24 of the operating dial 23 slidably in a direction along the injection port 15 of the nose portion 3 and is operated to rotate at inside of the guide hole 20 by operating to rotate the operating dial 23.

Figure 5:
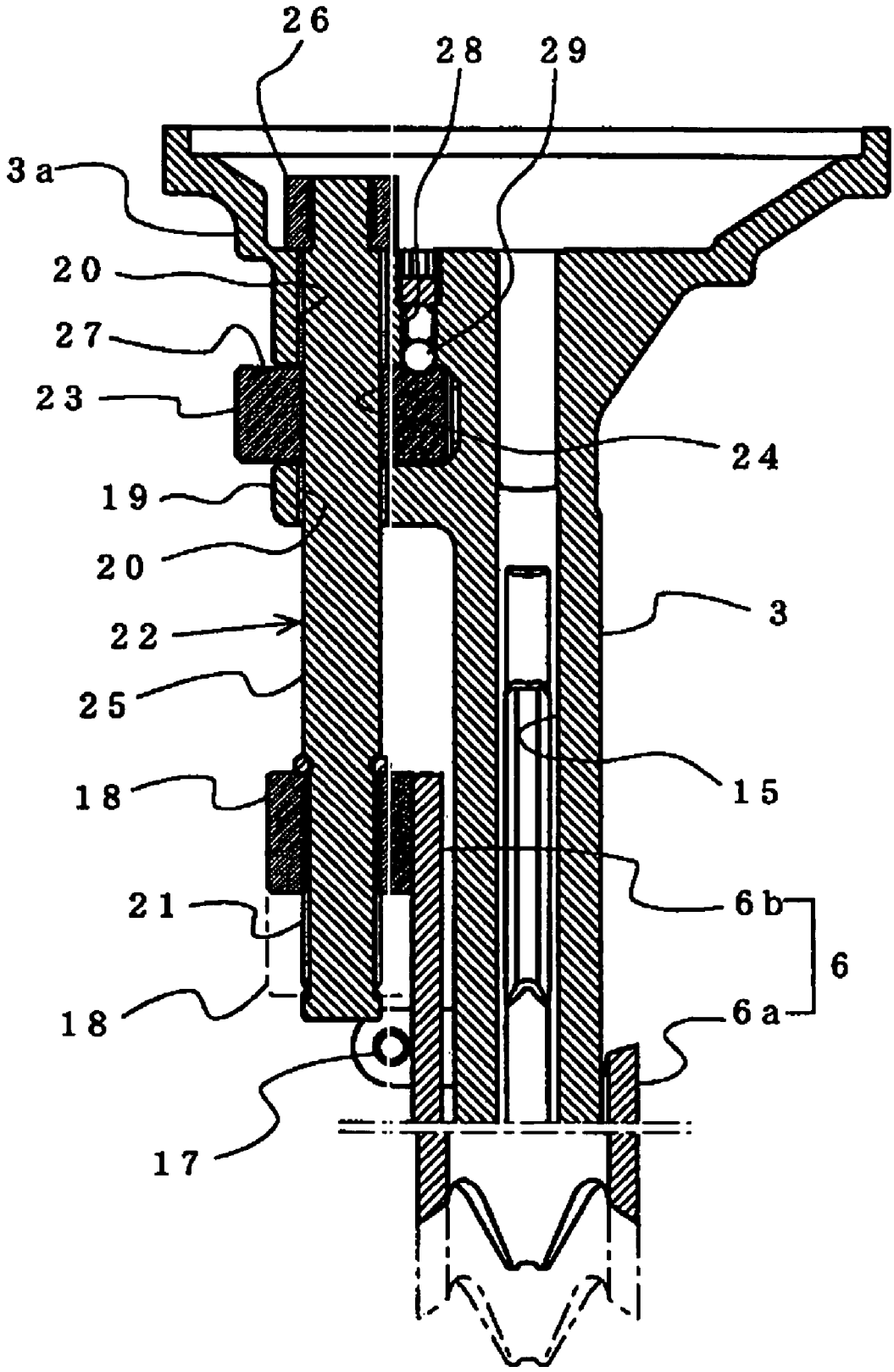
FIG. 5 is a sectional view enlarging a nose portion of the combustion gas drive nailing machine of FIG. 3.

As shown in FIG. 5 in details, the female screw portion 18 of the contact member 6 is screwed to be connected to the male screw portion 21 of the contact rod 22. When the contact rod 22 is rotated by operating the operating dial 23, the male screw portion 21 formed at the lower portion of the contact rod 22 is rotated integrally therewith, and the female screw portion 18 of the contact member 6 screwed to the male screw portion 21 is moved along the male screw portion 21. Thereby, the front end portion 6*a* of the contact member 6 formed in the ring-like shape is moved along the injection port 15 of the nose portion 3. As a result, a position of a front end of the contact member 6 can be adjusted relative to a front end face of the nose portion 3 variably to an arbitrary position. Further, the operating dial 23 is held relative to the nose portion 3 to be restricted from moving in the up and down direction between the flange portion 3*a* and the guide member 19, and the operating dial 23 is made to be able to be operated to rotate at a constant position. Further, although according to the embodiment, the female screw portion formed at the contact member is screwed to the male screw portion formed at the contact rod 22, a female screw may be formed at a front end of the guide rod, and a male screw portion formed at an upper end of the contact member may be screwed to the female screw.

An upper end portion of the contact rod 22 is arranged on an inner side of the housing 2 and on a side of an upper face of the flange portion 3*a* by penetrating the flange portion 3*a* formed at an upper end portion of the nose portion 3. A nut 26 is screwed to an upper end of the contact rod 22 to prevent the contact rod 22 from being drawn out from the guide hole 20. Further, a position of a lower dead center is determined by the bolt head portion or the nut by a structure of boring a hole in parallel with sides of the nut 26 and the driver hole to pass to the inner side of the nose. Further, the upper end of the contact rod 22 is arranged to be opposed to a lower end of the link member 14 connected to the movable valve 13 forming the combustion chamber 11. The combustion chamber 11 is opened and closed by operating the movable valve 13 by the contact rod 22 by way of the link member 14. Further, a spring may be interposed between the upper end of the contact rod 22 and a lower end of the link member 14 and the contact rod 22 may be urged always to a side of a struck member W by the spring. Thereby, even when the housing 2 is moved in a direction of being remote from the struck member W by a reaction in striking, the contact rod 22 urged by the spring can always be brought into contact with the struck member W.

Figure 6:
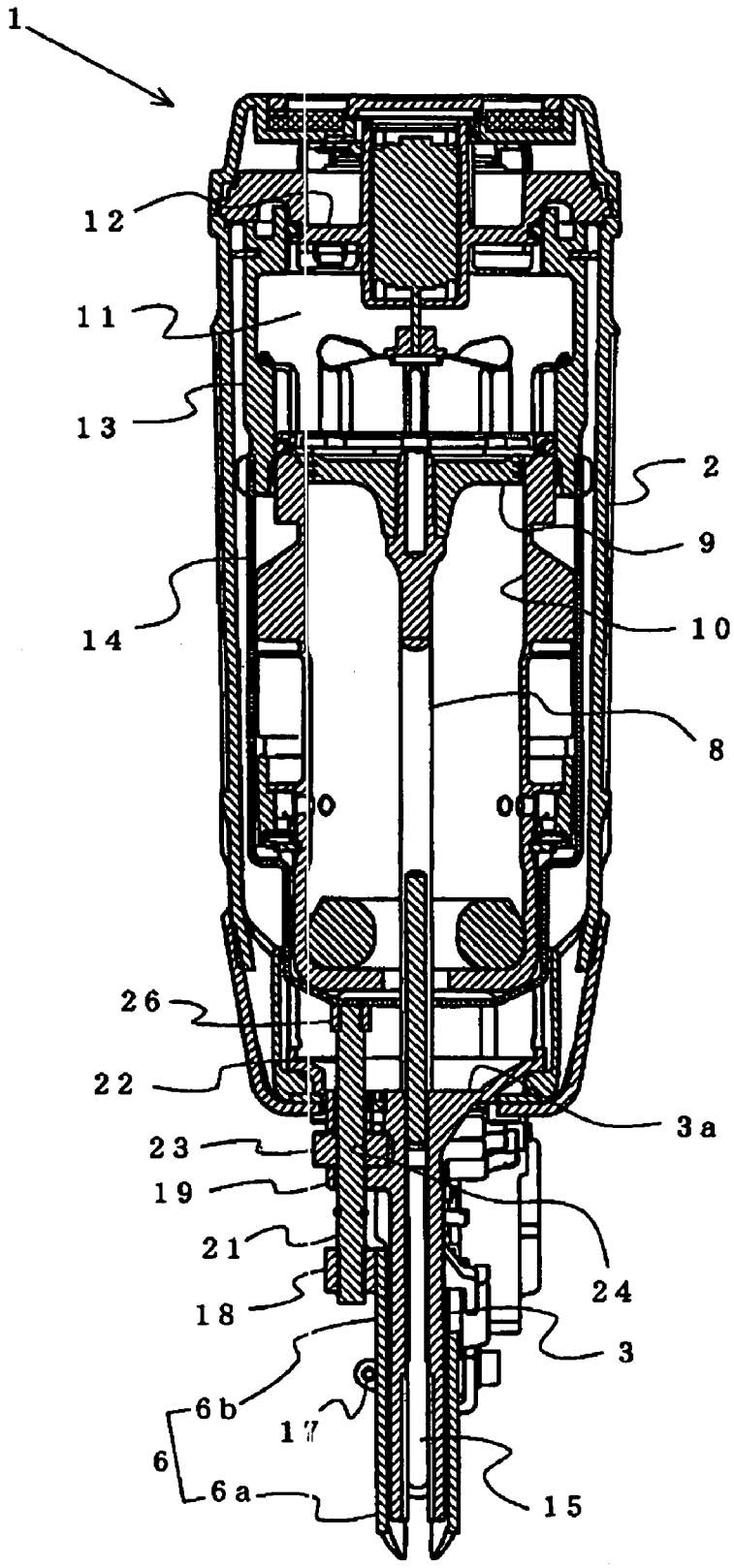
FIG. 6 is a sectional view similar to FIG. 2 showing a state of operating a contact member.

The link member 14 is operated with a downward directed urge force by a spring, not illustrated, ordinarily, as shown by FIG. 2, the movable valve 13 is arranged at a position of communicating inside of the combustion chamber 11 to the atmosphere by the urge force of the link member 14, and the front end portion of the contact member 6 is projected to be arranged from the front end of the nose portion 3 further in the front end direction by way of the contact rod 22 brought into contact with the link member 14. By operating to press the front end of the nose portion 3 to the struck member for activating the combustion gas drive nailing machine 1, as shown by FIG. 6, the contact member 6 is operated to slide along the injection port 17 of the nose portion 3 by being brought into contact with the struck member, the movable valve 13 is operated to an upper side by the contact rod 22 operated to slide integrally with the contact member 6 by way of the link member 14 to prepare to activate the combustion gas drive nailing machine 1 by shutting off inside of the combustion chamber 11 from the atmosphere to be brought into a hermetically closed state.

Further, as shown by FIG. 5, the operating dial 23 is positioned in a rotational direction by forming a plurality of recess portions 27 along a circumferential direction at an upper face of the operating dial 23 and elastically engaging a ball 29 contained at inside of a hole 28 formed at the nose portion 3 and urged to be pressed by a spring to thereby prevent a position of adjusting the contact member 6 from being shifted by unpreparedly rotating the operating dial 23 by an impact or the like when the combustion gas drive nailing machine 1 is operated and the nail is struck.

Figure 7A:
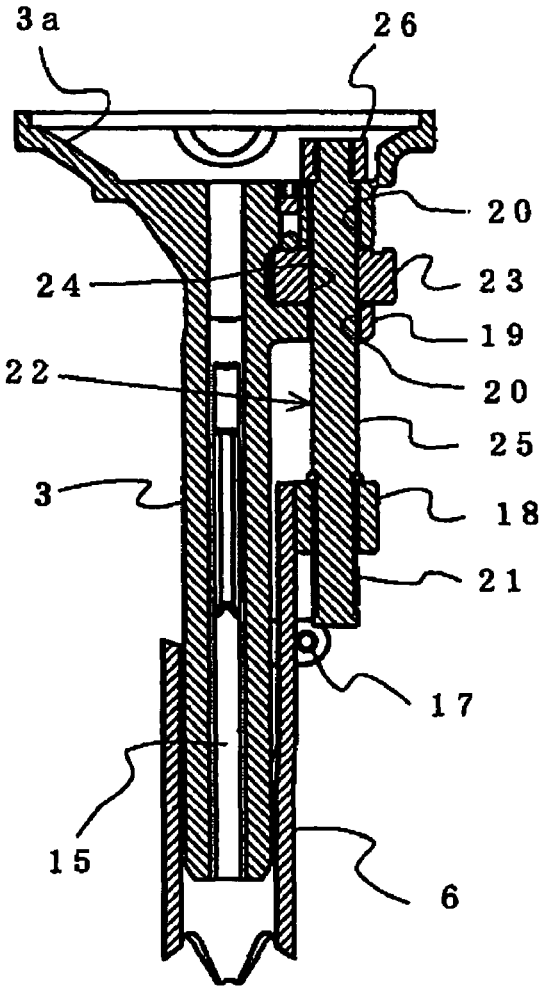
FIG. 7(*a*) shows a state before operating the contact member in the strike depth adjusting apparatus in which a depth of adjusting a nail is adjusted to be the deepest.
Figure 7B:
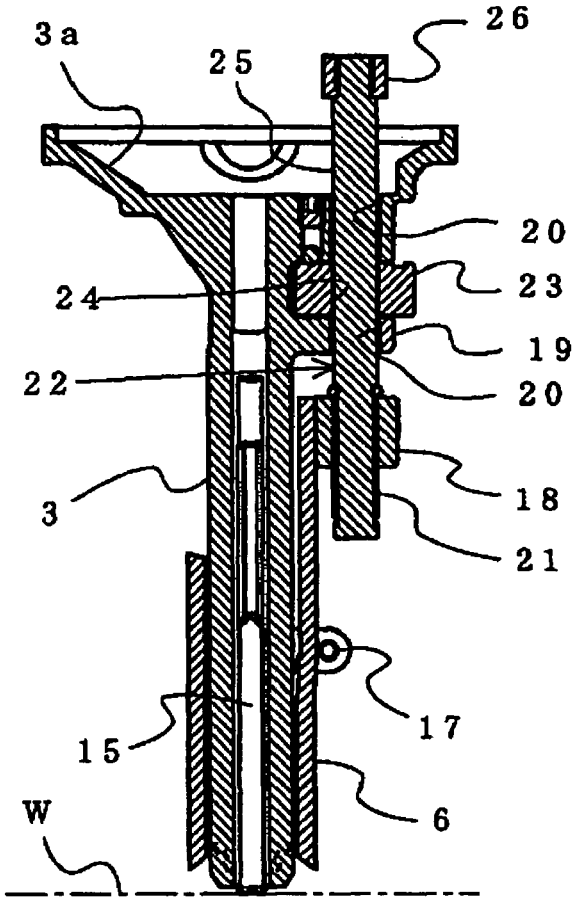

An explanation will be given of a state of operating the strike depth adjusting apparatus according to the embodiment as follows. FIG. 7(*a*) and FIG. 7(*b*) show the strike depth adjusting apparatus operated to adjust such that a depth of striking a nail becomes the deepest when a nail having a comparatively large length dimension is struck, or when a thickness of the struck member is thick to require a large force of striking a nail. As shown by FIG. 7(*a*), the combustion gas drive nailing machine 1 is adjusted such that the length of the contact member 6 projected from the front end of the injection port 15 of this nose portion 3 becomes the smallest by operating to rotate the operating dial 23, and the combustion gas drive nailing machine 1 adjusted in this way is activated. Therefore, as shown by FIG. 7(*b*), when the combustion gas drive nailing machine 1 is positioned such that the front end of the injection port 15 of the nose portion 3 is pressed to the struck member W, the front end of the contact member 6 is engaged with the struck member W and is operated to slide along the nose portion 3. Thereby, the contact rod 22 is operated to slide to the upper side, the movable valve 13 is operated to the upper side by way of the link member 14 engaged with the upper end of the contact rod 22 to prepare to activate the combustion gas drive nailing machine 1 by shutting off the combustion chamber 11 from the atmosphere. When the contact rod 22 operates the link member 14 to the position of the upper dead center, the front end of the injection port 15 of the nose portion 3 is arranged to be proximate to a vicinity of a surface of the struck member W, and a nail struck from the injection port 15 of this nose portion 3 by the driver 8 can be struck to the struck member W further deeply by a large power.

Figure 8A:
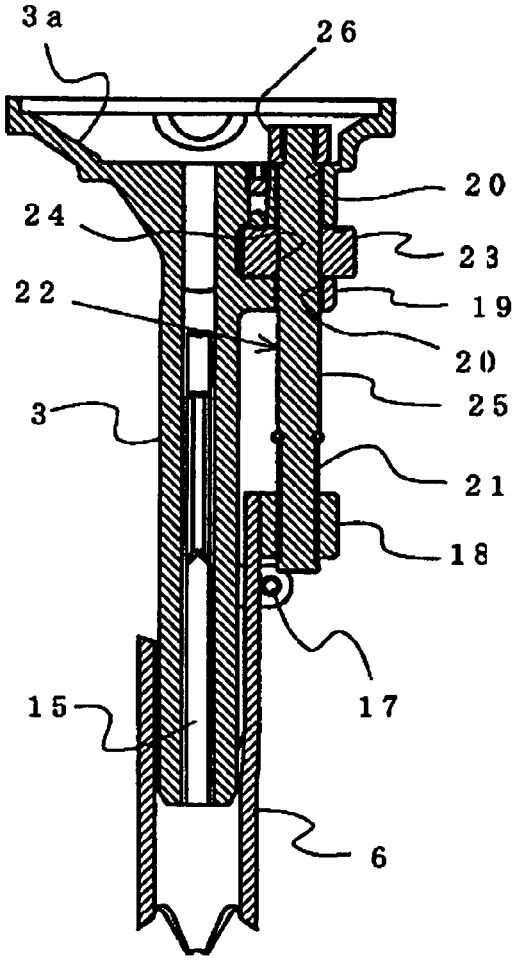
FIG. 8(*a*) shows a state before operating the contact member in the strike depth adjusting apparatus in which the depth of striking the nail is adjusted to be the shallowest.
Figure 8B:
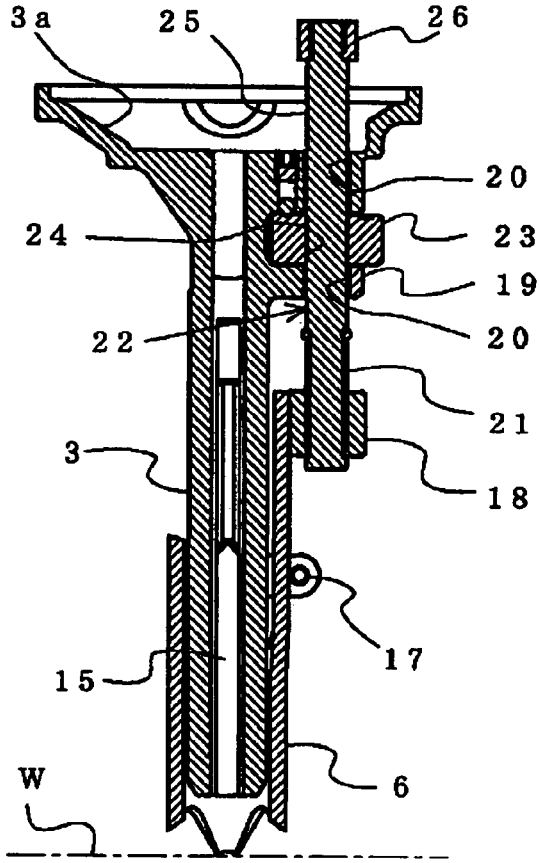

FIG. 8(*a*) and FIG. 8(*b*) show the strike depth adjusting apparatus operated to adjust such that the depth of striking a nail becomes the shallowest when a nail having a comparatively small length dimension is struck, or when a large strike force is not needed since the thickness of the struck member is thin. As shown by FIG. 8(*a*), the contact member 6 is adjusted such that the length of projecting in the front end direction relative to the nose portion 3 becomes the largest by operating to rotate the operating dial 23. Further, as shown by FIG. 8(*b*), the contact member 6 is operated to slide along the nose portion 3 by pressing the front end of the nose portion 3 to the struck member W. The movable valve 13 is operated to slide by the upper end of the contact rod 22 operated to slide to the upper side integrally with the contact member 6 by way of the link member 14 to thereby prepare to activate the combustion gas drive nailing machine 1 by shutting off the combustion chamber 11 from the atmosphere. When the contact rod 22 is operated to the position of the upper dead center, the front end of the injection port 15 of the nose portion 3 is arranged to be remote from the surface of the struck member W, and a nail struck from the injection port 15 of the nose portion 3 by the driver 8 can shallowly be struck to the struck member W by a small power.

Although in explaining the embodiment, an explanation has been given of the combustion gas drive nailing machine formed with the combustion chamber 11 at inside of the housing 2 and striking a nail by driving the piston 9 by the pressure of the combustion gas generated at inside of the combustion chamber 11, the invention can be embodied also in, for example, a compressed air drive nailing machine for introducing compressed air supplied from a compressed gas supply source by way of a hose or the like to thereby drive a piston by the compressed air and striking a nail to a struck member of wood or the like by a driver coupled to the piston. In such a compressed air drive nailing machine, the compressed air drive nailing machine may be activated by cooperating activation means constituted by an activation valve for introducing the compressed air to inside of the cylinder and a trigger lever for operating the activation valve and the like and the contact rod 22, and operating the activation means by the trigger lever operated by the hand grabbing the grip portion and the contact member 6 operated by the struck member.

Although an explanation has been given of the invention in details and in reference to the specific embodiment, it is apparent for the skilled person that the invention can variously be changed or modified without deviating from the spirit and the range of the invention.

The application is based on Japanese Patent Application (Japanese Patent Application No. 2004-296270) filed on Oct. 8, 2004, and a content thereof is incorporated herein by reference.

INDUSTRIAL APPLICABILITY

A length of projecting a contact member from a front end of a nose portion is made to be able to be adjusted without needing a tool and erroneous operation is prevented by transmitting movement of the contact member directly to an activationt control apparatus.

The invention claimed is:

1. A nailing machine comprising:

a nose portion;

an injection port formed at the nose portion;

a contact member arranged to be projected in a direction of a front end of the injection port and sliding along the nose portion;

a guide hole provided at a side portion of the nose portion;

a contact rod slidably and rotatably inserted into the guide hole, a lower end portion of which is connected to the contact member via a screw portion comprised of male and female threads; and an operating dial being penetrated by the contact rod slidably inserted therethrough, being integrally rotatable with the contact rod, and being rotatable and immovable in an up and down direction with respect to the nose portion.

2. The nailing machine according to claim 1, wherein by rotating the operating dial, the contact rod is rotated and a projecting length of the contact member in the direction of the front end of the nose portion is adjusted.

3. The nailing machine according to claim 1, further comprising:

an activation control apparatus for activating the nailing machine;

wherein an upper end portion of the contact rod is connected to the activation control apparatus, and the nailing machine is activated by operating to slide the contact member.

4. The nailing machine according to claim 3, further comprising:

a housing;

a cylinder provided inside of the housing;

a combustion chamber formed on a side of an upper portion of the cylinder; and a piston driven inside of the cylinder by a combustion gas generated inside of the combustion chamber;

wherein the activation control apparatus includes a movable valve for opening and closing an interval between the combustion chamber and the atmosphere;

wherein the contact rod is connected to a side of the movable valve by penetrating a flange portion formed at an upper end of the nose portion on a side of the upper end portion; and wherein the combustion chamber is shut off from the atmosphere to be hermetically closed by operating the movable valve by way of the contact rod by bringing the contact member into contact with a struck member to be operated to slide.

5. The nailing machine according to claim 1, wherein the contact rod includes a male screw at the lower end portion, the contact member includes a female screw, and the male screw and the female screw are connected.

6. The nailing machine according to claim 1, wherein the contact rod includes a female screw at the lower end portion, the contact member includes a male screw, and the female screw and the male screw are connected.

7. The nailing machine according to claim 1, wherein the contact rod includes a hexagonal section portion, the operating dial includes a hexagonal hole, and the hexagonal section portion is slidably inserted into the hexagonal hole in an axial direction of the contact rod, and the contact rod and the operating dial are integrally rotated.

8. The nailing machine according to claim 1, further comprising:

a flange portion provided at the nose portion; and a guide member provided on a lower side of the flange portion;

wherein the operating dial is interposed between the flange portion and the guide portion and is restricted from being moved in an up and down direction.

9. The nailing machine according to claim 1, wherein the operating dial is formed of a synthetic resin.

10. The nailing machine according to claim 1, wherein the contact rod is constituted substantially by a straight shape.

* * * * *